US011452904B1

(12) United States Patent
Lagree et al.

(10) Patent No.: US 11,452,904 B1
(45) Date of Patent: Sep. 27, 2022

(54) DOOR MOUNT SYSTEM FOR EXERCISE DEVICES

(71) Applicant: Lagree Technologies, Inc., Chatsworth, CA (US)

(72) Inventors: Sebastien Anthony Louis Lagree, Chatsworth, CA (US); Max E. Wunderlich, Los Angeles, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 0 days.

(21) Appl. No.: 17/236,331

(22) Filed: Apr. 21, 2021

(51) Int. Cl.
*A63B 21/16* (2006.01)
*A63B 21/04* (2006.01)

(52) U.S. Cl.
CPC ..... *A63B 21/1645* (2013.01); *A63B 21/0442* (2013.01)

(58) Field of Classification Search
CPC ..... A63B 21/1645; A63B 21/0442; A63B 21/1636; A63B 21/0557; A63B 21/1618; A63B 21/1627; A63B 21/1654; A63B 21/1663; A63B 21/1218; F16B 2/065; Y10T 403/7067; A61H 2201/0123; A47G 25/0614; A47G 27/0418; A47G 27/0425
See application file for complete search history.

(56) References Cited

U.S. PATENT DOCUMENTS 4,116,434 A * 9/1978 Bernstein ..... A63B 21/1645 D21/687
4,468,022 A * 8/1984 Wu ..... A63B 23/0211 482/140
4,722,523 A 2/1988 Yang
5,186,702 A * 2/1993 Amanze ..... A63B 23/0211 482/145
D372,507 S * 8/1996 Chin ..... D21/687
5,871,424 A 2/1999 Conner
6,612,972 B1 9/2003 Reichard
7,048,638 B2 5/2006 Novotny
7,431,680 B1 10/2008 Hinds
8,057,370 B2 11/2011 Dunn
2004/0097349 A1 5/2004 Rogers
(Continued)

FOREIGN PATENT DOCUMENTS

GB 2227949 A * 8/1990 ..... A63B 21/023

OTHER PUBLICATIONS https://axtionfitness.com/products/anchor-gym-door-mini-h1-2-pack; Axtion Fitness Anchor Gym Door Mini H1-2 Pack Webpage; Jan. 12, 2021.

*Primary Examiner* — Jennifer Robertson
*Assistant Examiner* — Christian R Rodriguez
(74) *Attorney, Agent, or Firm* — Neustel Law Offices

(57) ABSTRACT

A door mount system for securing exercise devices to a door for use by a user. The door mount system includes a support member, a securing member, an attachment member, and an adjustment member. The adjustment member is adapted to move the securing member. A securing member is adapted to press on the door to removably connect the support member to the door. The attachment member is adapted to connect to an exercise device. The door mount system may further include guide members and slots. The guide members slidably move in the slots to prevent rotation of the securing member. The attachment member may include one or more eyelets adapted to connect to the exercise device.

19 Claims, 14 Drawing Sheets

(56) References Cited

U.S. PATENT DOCUMENTS

| | | | | |
|---|---|---|---|---|
| 2005/0221964 | A1* | 10/2005 | Liester | A63B 23/1209 482/904 |
| 2010/0222809 | A1 | 9/2010 | Grabill | |
| 2011/0195825 | A1 | 8/2011 | Liester | |
| 2015/0306447 | A1 | 10/2015 | Neal-Buhler | |
| 2020/0063475 | A1* | 2/2020 | Seelbinder | G08B 5/36 |

* cited by examiner

DOOR MOUNT SYSTEM FOR EXERCISE DEVICES

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

The described example embodiments in general relate to mounts for doors for supporting exercise devices.

Any discussion of the related art throughout the specification should in no way be considered as an admission that such related art is widely known or forms part of common general knowledge in the field.

A door mount enables a user to mount an exercise device to a door while exercising. However, users may benefit from a door mount system that includes one or more guide members that prevent rotation of a securing member that removably couples the door mount system to the door. Users may further benefit from an attachment member that includes one or more eyelets for connecting to the exercise equipment.

SUMMARY

Some of the example embodiments of the present disclosure relate to a door mount system that mounts to a door to support exercise equipment. Some of the various example embodiments of the present disclosure include a support member, a securing member, an attachment member and an adjustment member. In some example embodiments, the door mount system includes a first guide member and a second guide member, and the support member includes a first slot and a second slot. The first guide member and the second guide member are slidably positioned in the first slot and the second slot respectively. The guide members are adapted to remain positioned in the slots respectively to prevent rotation of the securing member. In some example embodiments, the attachment member may include one eyelet or a plurality of eyelets to which an exercise device may be removably connected.

There has thus been outlined, rather broadly, some of the embodiments of the present disclosure in order that the detailed description thereof may be better understood, and in order that the present contribution to the art may be better appreciated. There are additional embodiments of that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

A. Overview

Figure 1:
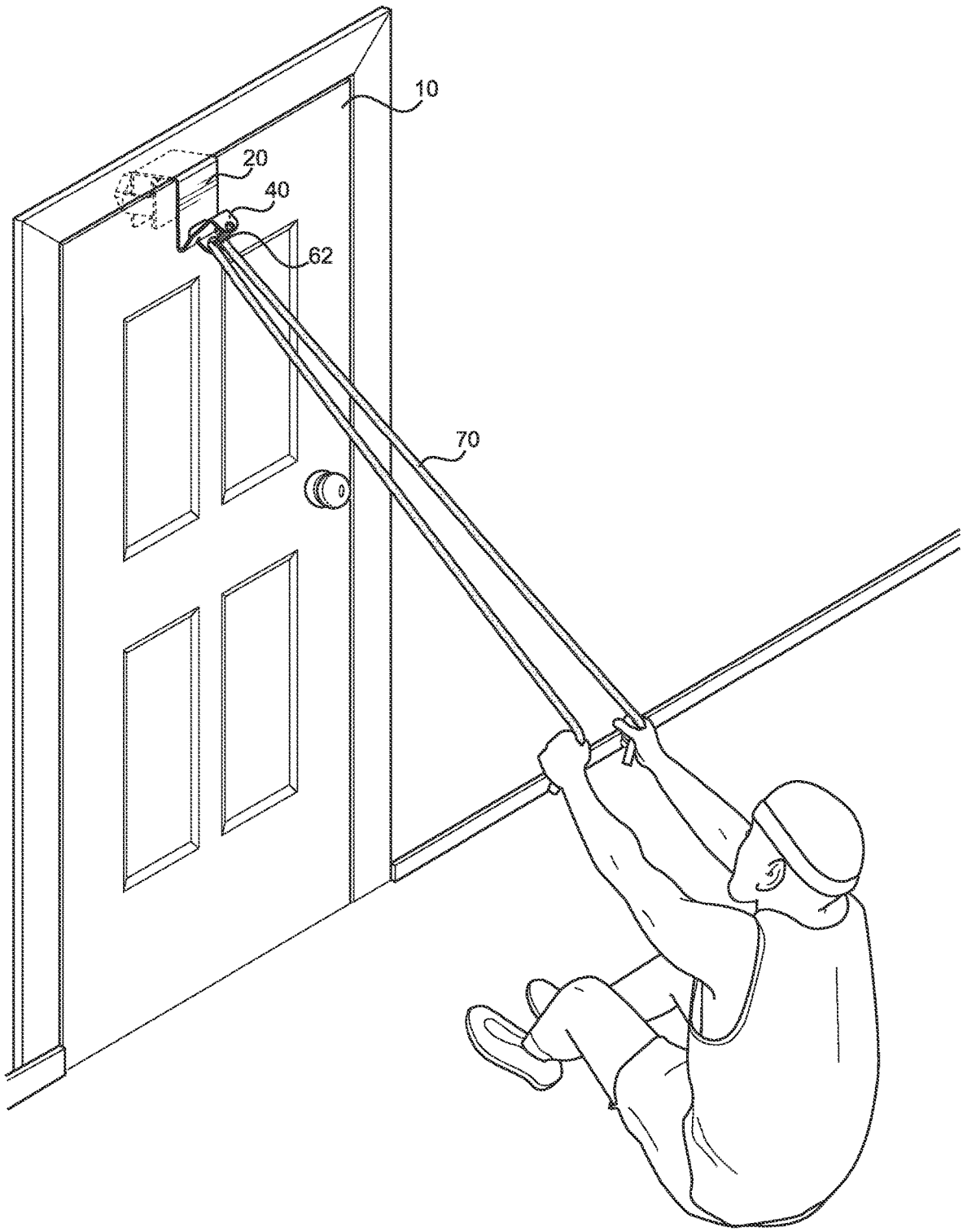
FIG. 1 is a perspective view of a door mount system for exercise devices in accordance with an example embodiment.

An exercise device provides a resistance force (e.g., resilient, mass, biasing, tension, etc.) against which a user exercises to strengthen muscles. An exercise device typically utilizes a mount (e.g., anchor, holder, support, base) that holds the exercise device so it can provide the resistance force to the user. A door mounting system may be attached to a door to function as a mount for an exercise device.

Some of the various example embodiments of the present disclosure relate to a door mounting system adapted to removably connect to a door 10 to provide a mount for an exercise device (e.g., 70, 72, 74, 76, 78). Some of the various example embodiments of the present disclosure include a support member 20 adapted to removably connect to a door 10, a securing member 30 adapted to press against the door 10 to removably connect the support member 20 to the door 10, an adjustment member 50 adapted to move the securing member 30 toward or away from the door 10 to connect or release the support member 20 to or from the door 10, and an attachment member 40 adapted to couple to the exercise device.

In some example embodiments, the door mounting system further includes a first guide member 32 and a second guide member 34 adapted to guide the securing member 30 as it moves toward or away from the door 10. The guide members 32 and 34 are positioned in a first slot 22 and a second slot 24 respectively that extend into the side edges of a rear side portion 28 of the support member 20. The guide members 32 and 34 are adapted to slidably move in the slots 22 and 24 as the securing member 30 moves toward or away from the door 10. The guide members 32 and 34 remain in the slots 22 and 24 as the securing member 30 moves and as the securing member 30 presses against the door 10. The guide members 32 and 34 prevent rotation of the securing member 30 thereby strengthening the connection between the door 10 and the support member 20.

In some other example embodiments, the attachment member 40 of the door mounting system includes one or more eyelets 42 or 44 that are adapted to couple to an exercise device. In an example embodiment that includes at least two eyelets 42 and 44, the attachment member 40, and thus the at least two eyelets 42 and 44, may be positioned at an angle with respect to the door 10 so that a force exerted by the exercise device on the attachment member 40 is evenly distributed between the at least two eyelets 42 and 44.

In other example embodiments, the door mounting system further includes a connection member (e.g., threaded fastener 62, wire-lock clevis pin 64, carabiner 60) position through the at least two eyelets 42 and 44 to facilitate connecting the exercise device to the at least two eyelets 42 and 44.

B. Support Member

A door mount system includes a support member 20. As best seen in FIGS. 1-2 and 14-17, the support member 20 is adapted to removably connect (e.g., couple) to a door 10. In particular, the support member 20 is adapted to removably connect to an upper end of the door 10. The support member 20 functions as a support for an exercise device. The support member 20 functions as an anchor from which the exercise device provides a resistance force to a user.

The support member 20 may be formed in any shape suitable for removably connecting to the door 10. For example, as best seen in FIGS. 1-6 and 11-17, the support member 20 may have an inverted U-shape. The inverted U-shape may be positioned over the upper end of the door 10.

In an example embodiment, the support member 20 includes a front side portion 27, a rear side portion 28 and a top side portion 29 extending between the front side portion 27 and the rear side portion 28. The front side portion 27 is positioned opposite the rear side portion 28. The top side portion 29 is positioned upwardly with the front side portion 27 and the rear side portion 28 positioned downwardly to establish the inverted U-shape. When the support member 20 is placed over the upper end of the door 10, an inner surface of the top side portion 29 contacts the upper end of the door 10. An inner surface of the front side portion 27 is positioned proximate to a first side of the door 10 (e.g., side toward the user). An inner surface of the rear side portion 28 is positioned proximate to a second side of the door 10 (e.g., side away from the user) opposite the first side of the door 10. In an example embodiment, the front side portion 27 is substantially parallel to the rear side portion 28.

In an example embodiment, as best seen in FIGS. 3-4, 8 and 10-13, the support member 20 further includes a first slot 22 extending into a first side edge of the rear side portion 28 and a second slot 24 extending into a second side edge of the rear side portion 28. The first side edge is opposite of the second side edge, so the first slot 22 is positioned opposite the second slot 24. The first slot 22 and the second slot 24 are adapted to receive the first guide member 32 and the second guide member 34 respectively. The first slot 22 and the second slot 24 are of sufficient depth to receive the first guide member 32 and the second guide member 34 respectively.

The first guide member 32 and the second guide member 34 extend from the securing member 30. The first guide member 32 and the second guide member 34 are slidably positioned in the first slot 22 and the second slot 24 respectively. As the securing member 30 moves, the first guide member 32 and the second guide member 34 are adapted to slide in the first slot 22 and the second slot 24 respectively. The first guide member 32 and the second guide member 34 slide along their length in the first slot 22 and in the second slot 24.

As the securing member 30 moves, the first guide member 32 and the second guide member 34 are adapted to remain positioned in the first slot 22 and the second slot 24 respectively. In an example embodiment, the guide members 32 and 34 are formed of a stiff material (e.g., metal, plastic) that helps retain the guide members 32 and 34 in the slots 22 and 24 respectively. In an example embodiment, the first slot 22, the second slot 24, the first guide member 32 and/or the second guide member 34 may include structures (e.g., tongue and groove, loop, retaining bracket, channel) to retain the guide members 32 and 34 in the slots 22 and 24 respectively.

In an example embodiment, the support member 20 has a front side portion 27, a rear side portion 28, a top side portion 29 extending between the front side portion 27 and the rear side portion 28, a first slot 22 extending into a first side edge of the rear side portion 28, and a second slot 24 extending into a second side edge of the rear side portion 28. The first side edge is opposite of the second side edge. The front side portion 27 is opposite the rear side portion 28.

An adjustment member 50 is adapted to move the securing member 30. The securing member 30 is adapted to press the door 10 against the inner surface of the front side portion 27 of the support member 20 to secure the support member 20 to the door 10. The adjustment member 50 applies a force against the rear side portion 28 of the support member 20. The rear side portion 28 functions as a base (e.g., foundation, anchor, support) against which the adjustment member 50 applies the force (e.g., push). The adjustment member 50 translates (e.g., transfers) the force applied against the rear side portion 28 into a force applied against the securing member 30. The force pushes the securing member 30 into contact with the door 10. The force pushes the securing member 30 against the door 10 to move the door 10 into contact with the inner surface of the front side portion 27 of the support member 20. The force applied between the rear side portion 28 and the front side portion 27 via the adjustment member 50, the securing member 30 and the door 10 secure the support member 20 to the door 10.

The connection between the rear side portion 28 and the front side portion 27 to the top side portion 29 has sufficient strength to withstand the force applied from the rear side portion 28 to the front side portion 27 via the adjustment member 50, the securing member 30 and the door 10 without breaking. The support member 20 may be formed of any material of sufficient strength to withstand the force applied between the rear side portion 28 and the front side portion 27. In an example embodiment, the support member 20 is formed of metal. In an example embodiment, the support member 20 is formed of a single piece of metal that is stamped (e.g., bent, shaped) to form the inverted U-shape. In an example embodiment, the support member 20 is formed of a high strength plastic. In an example embodiment the support member 20 is formed of a combination of metal and high-strength plastic.

The support member 20 may further include a first gripping member 26. The first gripping member 26 is adapted to grip against (e.g., cling to) the door 10. The first gripping member 26 is formed of a material (e.g., foam, rubber) that grips. The first gripping member 26 may be formed of a resilient material. The first gripping member 26 helps the support member 20 remain connected to the door 10. In an example embodiment, the first gripping member 26 is positioned on an inner surface of the front side portion 27 of the support member 20. The first gripping member 26 is adapted to be positioned between an inner surface of the front side portion 27 of the support member 20 and the door 10. The first gripping member 26 is adapted to connect (e.g., couple, stick, engage) to the inner surface of the front side portion 27 of the support member 20. The first gripping member 26 connects to the front side portion 27 in any manner (e.g., glue, magnetic force). The first gripping member 26 is adapted to be positioned proximate to the door 10. The first gripping member 26 is adapted to come into contact with the door 10 to grip the door 10.

In an example embodiment, the support member 20 further comprises the first gripping member 26 connected to an inner surface of the front side portion 27. The securing member 30 is adapted to press the door 10 against the first gripping member 26 to removably connect the support member 20 to the door 10.

C. Adjustment Member

A door mount system includes an adjustment member 50. The adjustment member 50 is adapted to move the securing member 30 toward or away from the door 10. The adjustment member 50 is adapted to move the securing member 30 away from or toward the rear side portion 28 of the support member 20. The adjustment member 50 moves the securing member 30 toward the door 10 to connect (e.g., secure, fasten, attach) the support member 20 to the door 10. The adjustment member 50 moves the securing member 30 away from an inner surface of the rear side portion 28 of the support member 20 to move the securing member 30 toward the door 10. As best seen in FIGS. 2 and 4-8, the adjustment member 50 moves the securing member 30 into contact with the door 10 to connect the support member 20 to the door 10. The adjustment member 50 moves the securing member 30 away from the door 10 to release (e.g., disconnect) the support member 20 from the door 10. The adjustment member 50 moves the securing member 30 toward the inner surface of the rear side portion 28 of the support member 20 to move the securing member 30 away from the door 10.

In an example embodiment, the door mount system includes the adjustment member 50 connected to the securing member 30 and the rear side portion 28 of the support member 20. The adjustment member 50 is adapted to move the securing member 30 toward the door 10 to secure the support member 20 to the door 10. The adjustment member 50 is adapted to move the securing member 30 away from the door 10 to disconnect the support member 20 from the door 10.

In an example embodiment, at least a portion of the adjustment member 50 is positioned between the rear side portion 28 of the support member 20 and the securing member 30. The adjustment member 50 applies a pushing force against the rear side portion 28 to move the securing member 30 toward the door 10. The adjustment member 50 applies a pulling force against the rear side portion 28 to move the securing member 30 away from the door 10. The adjustment member 50 translates the force against the rear side portion 28 into a force (e.g., pulling, pushing) against the securing member 30 to move the securing member 30.

The adjustment member 50 may apply a force to the securing member 30 to hold (e.g., retain) the securing member 30 in a position. In an example embodiment, the adjustment member 50 applies a continuous force to the securing member 30 (e.g., from the rear side portion 28 to the securing member 30) to press and hold the securing member 30 against the door 10. The adjustment member 50 maintains the force against the securing member 30 to maintain the connection between the support member 20 and the door 10. A force applied by the adjustment member 50 to the securing member 30 is translated (e.g., transferred) to the front side portion 27 of the support member 20 via the securing member 30 and the door 10. Because the adjustment member 50 applies the force against the rear side portion 28 of the support member 20, the adjustment member 50 applies a force between the rear side portion 28 and the front side portion 27 via the adjustment member 50, the securing member 30 and the door 10.

The adjustment member 50 may include any structure suitable for applying a force to the rear side portion 28 of the supporting structure and/or applying a force to the securing member 30. In an example embodiment, the adjustment member 50 includes a threaded member. In another example embodiment, the adjustment member 50 includes a pawl or a ratchet arm. In another example embodiment, the adjustment member 50 includes a gear or a rack.

The adjustment member 50 may connect to the rear side portion 28 of the support member 20 to apply a force to the rear side portion 28. The adjustment member 50 may connect to the securing member 30 to apply a force to the securing member 30. The adjustment member 50 may connect between the rear side portion 28 and the securing member 30 to apply a force on the securing member 30. The adjustment member 50 may include any structure (e.g., threaded hole, T nut, clip) for connecting to the rear side portion 28 of the supporting member and/or the securing member 30. In an example embodiment, a portion of the adjustment member 50 is integral (e.g., formed of a single piece of material) with the securing member 30. In an example embodiment, a portion of the adjustment member 50 is integral with the rear side portion 28.

In an example embodiment, the adjustment member 50 includes a threaded member connected to the securing member 30 and the rear side portion 28 of the support member 20. The securing member 30 is adapted to move responsive to rotation of the threaded member. In an example embodiment, the threaded member is threadably connected to the rear side portion 28 of the support member 20. In an example embodiment, the adjustment member 50 includes a bolt 54 with threads. A first end portion of the bolt 54 is rotatably connected to the securing member 30. A length of the bolt 54 is threadably connected to the rear side portion 28 of the support member 20. A second end portion of the bolt 54 is connected to a knob 52. Rotating (e.g., turning) the knob 52 in a clockwise direction rotates the bolt 54 with respect to the threads of the rear side portion 28 so that the bolt 54 moves the securing member 30 away from the rear side portion 28 (e.g., toward the door 10). Rotating the knob 52 in a counterclockwise direction rotates the bolt 54 with respect to the threads of the rear side portion 28 so that the bolt 54 moves the securing member 30 toward the rear side portion 28 (e.g., away from the door 10).

In an example embodiment, the adjustment member 50 includes a bolt 54 with threads along its length, a nut 56 with internal threads, and a knob 52. The nut 56 is attached (e.g., affixed, glued, crimped, welded) to the rear side portion 28 of the support member 20. The rear side portion 28 of the support member 20 includes a hole that is coaxial with the nut 56 and of a larger diameter than the interior diameter of the nut 56 so that the bolt 54 is threaded through the nut 56 and passes through the hole. The bolt 54 is threaded through the nut 56 to position a first end portion of the bolt 54 between an inner surface of the rear side portion 28 and the securing member 30. The end of the first end portion of the bolt 54 is rotatably connected to the securing member 30 (e.g., clip washer, clip, tooth clips, push-on locking washer). The end of the first end portion of the bolt 54 may exclude threads to facilitate a rotatable connection to the securing member 30. The end of the first end portion of the bolt 54 is rotatably connected to the securing member 30, so that the securing member 30 does not rotate as the bolt 54 rotates. The second end portion of the bolt 54 extends away from an outer surface of the rear side portion 28 of the support member 20. The knob 52 is connected to the end of the second end portion of the bolt 54. Rotating the knob 52 in a clockwise direction rotates the bolt 54 with respect to the threads of the nut 56 so that the bolt 54 moves the securing member 30 away from the rear side portion 28. Rotating the knob 52 in a counterclockwise direction rotates the bolt 54 with respect to the threads of the nut 56 so that the bolt 54 moves the securing member 30 toward the rear side portion 28.

Whether the rear side portion 28 of the support member 20 includes threads or a nut 56, the threaded member (e.g., bolt 54) of the adjustment member 50 is threadably connected to the rear side portion 28 of the support member 20.

D. Securing Member

As best seen in FIGS. 2-6, 8 and 11-13, a door mount system includes a securing member 30. A securing member 30 is adapted to removably connect the support member 20 to the door 10. The securing member 30 is adapted to move with respect to the support member 20 to press against the door 10 to removably connect the support member 20 to the door 10. The securing member 30 is further adapted to move with respect to the support member 20 to cease pressing against the door 10 to release the support member 20 from the door 10.

A securing member 30 receives a force from the adjustment member 50. The securing member 30 translates (e.g., transfers) the force to the door 10. The securing member 30 translates the force to the door 10 through contact with the door 10. The force presses the securing member 30 against the door 10 and the door 10 against an inner surface of a front side portion 27 of the support member 20. The force against the door 10 secures the support member 20 to the door 10.

The securing member 30 may include any structure suitable for receiving a force from the adjustment member 50. The securing member 30 may include a rear portion for receiving the force from the adjustment member 50. The securing member 30 may include any structure suitable for translating the force from the adjustment member 50 to a force on the door 10. The securing member 30 may respond to the force from the adjustment member 50 by pressing on the door 10. The securing member 30 may include a front portion for pressing on the door 10. The securing member 30 may press the front portion of the securing member 30 against the door 10 to secure the support member 20 to the door 10. The securing member 30 may respond to a force from the adjustment member 50 by moving away from the door 10. The securing member 30 may move away from the door 10 to release the support member 20 from the door 10. The securing member 30 may be positioned between an inner surface of the rear side portion 28 of supporting member and the door 10.

The securing member 30 may include any structure or be formed in any shape suitable for pressing against a door 10. In an example embodiment, the securing member 30 includes a plate. The plate includes a flat surface for pressing against the door 10. In an example embodiment, the front portion of the plate is a flat surface. In another example embodiment, one or more portions of the front portion of the plate are flat surfaces. A rear portion of the plate may include structures (e.g., ridges, beams, protrusions, openings, folds) for coupling to an end portion of the adjustment member 50. The rear portion of the plate may include structures for rotatably coupling to the adjustment member 50.

A securing member 30 may be formed of a material suitable for translating a force on the securing member 30 into a force on the door 10. A securing member 30 may be formed of a rigid material. A securing member 30 may be formed of a resilient (e.g., pliable) material. A securing member 30 may be formed of a combination of a rigid material and a resilient material. In an example embodiment, the securing member 30 is formed of metal. In an example embodiment, the securing member 30 is formed of a hard plastic. In an example embodiment, the securing member 30 is formed of a durable rubber. In an example embodiment, the securing member 30 is formed of a combination of metal, plastic and/or rubber.

As best seen in FIGS. 2-6, 8 and 11-13, the securing member 30 further includes a second gripping member 36 connected to a surface of the securing member 30. The second gripping member 36 is formed of a material that grips. The second gripping member 36 may be formed of a resilient material. The second gripping member 36 is adapted to grip against the door 10. The second gripping member 36 grips against the door 10 to connect the support member 20 to the door 10. The second gripping member 36 is adapted to be positioned between the securing member 30 and the door 10. The second gripping member 36 may connect to the securing member 30 in any manner. The second gripping member 36 is adapted to come into contact with the door 10 to grip the door 10.

In an example embodiment, the support member 20 includes the first gripping member 26 and the securing member 30 includes the second gripping member 36. The first gripping member 26 is connected to an inner surface of the front side portion 27 of the support member 20. The second gripping member 36 is connected to a surface of the securing member 30. The securing member 30 is adapted to press the door 10 between the first gripping member 26 and the second gripping member 36 to removably connect the support member 20 to the door 10.

As the adjustment member 50 moves the securing member 30 away from the door 10, the second gripping member 36 ceases to contact the door 10. As the adjustment member 50 moves the securing member 30 away from the door 10, the pressure of the door 10 against the first gripping member 26 ceases. Because the second gripping member 36 has moved away from the door 10 and the pressure of the door 10 against gripping member 26 has stopped, the second gripping member 36 and the first gripping member 26 cease to grip against the door 10, thereby releasing the support member 20 from the door 10.

E. Guide Member

A door mount system may include one or more guide members. In an example embodiment, a door mount system includes one guide member, for example, the first guide member 32. In an example embodiment, the door mount system includes three guide members. In an example embodiment, the door mount system includes a first guide member 32 and a second guide member 34. As best seen in FIGS. 2-8 and 10-13, the guide members 32 and 34 guide the movement of the securing member 30. The guide members 32 and 34 guide the movement of the securing member 30 as it moves toward and away from the door 10 or away from and toward the rear side portion 28 of the securing member 30. The guide members 32 and 34 cooperate with the rear side portion 28 of the securing member 30 to prevent rotation of the securing member 30. The guide members 32 and 34 cooperate with the slots 22 and 24 to position the securing member 30. The guide members 32 and 34 cooperate with the slots 22 and 24 to apply the force from the adjustment member 50 to the securing member 30 and against the door 10.

The guide members 32 and 34 extend from the securing member 30 toward the rear side portion 28 of the support member 20. In an example embodiment, the guide members 32 and 34 are connected to the securing member 30. In an example embodiment, the guide members 32 and 34 are integral (e.g., formed of a single piece) with the securing member 30. The guide members 32 and 34 extend from the securing member 30 into the slots 22 and 24 respectively. The guide members 32 and 34 are slidably positioned in the slots 22 and 24 respectively. As the securing member 30 moves toward or away from the rear side portion 28 of the support member 20, the guide members 32 and 34 slidably move in the slots 22 and 24. As the securing member 30 moves toward or away from the rear side portion 28 of the support member 20, the guide members 32 and 34 remain in the slots 22 and 24.

The first guide member 32 and the second guide member 34 extend from the securing member 30 into the first slot 22 and the second slot 24 respectively, through the slots 22 and 24 to extend beyond an outer (e.g., rearward) surface of the rear side portion 28 of the support member 20.

The guide members 32 and 34 may be positioned parallel to each other to facilitate slidable movement in the slots 22 and 24. The guide members 32 and 34 may be positioned parallel to each other to facilitate keeping the guide members 32 and 34 in the slots 22 and 24 respectively as the securing member 30 moves. In an example embodiment, the first guide member 32 and the second guide member 34 extend orthogonally from the securing member 30. The guide members 32 and 34 extend orthogonally from the securing member 30 to position the guide members 32 and 34 parallel to each other.

The first slot 22 may be formed in a first side edge of the rear side portion 28 of the support member 20. The second slot 24 may be formed in a second side edge of the rear side portion 28 of the support member 20. The first slot 22 and the second slot 24 are positioned a distance away from each other. A distance between the first guide member 32 and the second guide member 34 is the same distance as between the first slot 22 and the second slot 24, so that the first guide member 32 and the second guide member 34 may be slidably positioned in the first slot 22 and the second slot 24.

The first guide member 32 and the second guide member 34 may be formed of a stiff material. The guide members 32 and 34 may be formed of a stiff material to maintain the position of the first guide member 32 with respect to the second guide member 34. The guide members 32 and 34 may be formed of a stiff material to maintain the position of the guide members 32 and 34 with respect to the slots 22 and 24. In an example embodiment, the guide members 32 and 34 are formed of metal, plastic or a combination thereof. In an example embodiment, the guide members 32 and 34 are integral with the securing member 30, so the securing member 30 and the guide members 32 and 34 are formed of the same material or the same combination of materials. In an example embodiment, the securing member 30 is formed of metal that is stamped to form the first guide member 32 as a first tab that extends from the securing member 30 and the second guide member 34 as a second tab that extends from the securing member 30. So, in this example embodiment the first guide member 32 and the second guide member 34 comprise a first tab and a second tab respectively.

The first guide member 32 and the second guide member 34 may retain their position relative to each other and relative to the first slot 22 and the second slot 24 as the securing member 30 moves. In an example embodiment in which the guide members 32 and 34 retain their position relative to each other and relative to the slots 22 and 24, the guide members 32 and 34 remain positioned in the slots 22 and 24 as the securing member 30 moves.

The adjustment member 50 may rotate to move the securing member 30. As the adjustment member 50 rotates, the securing member 30 may also have a tendency to rotate. As the securing member 30 rotates, the guide members 32 and 34 come into contact with a side of the first slot 22 and a side of the second slot 24. Contact of the guide members 32 and 34 with the side of the slots 22 and 24 keeps the securing member 30 from rotating. Because the securing member 30 does not rotate, the securing member 30 makes secure contact with the door 10 because the securing member 30 does not rotate with respect to the door 10. Because the securing member 30 does not rotate, the securing member 30 may establish a contact point with the door 10 and maintain that contact point because the securing member 30 does not rotate. Maintaining the contact point, without rotation, allows the securing member 30 to press more firmly on the door 10.

The first guide member 32 and the second guide member 34 operate to keep the securing member 30 parallel to the rear side portion 28 of the support member 20 and thereby parallel to the door 10. As the securing member 30 moves, if it moves out of parallel with the rear side portion 28, the guide members 32 and 34 come into contact with the side of the slots 22 and 24. Contact with the side of the slots 22 and 24 moves the securing member 30 back into a parallel position with respect to the rear side portion 28.

As the securing member 30 moves, the first guide member 32 and the second guide member 34 are adapted to remain positioned in the first slot 22 and the second slot 24 respectively thereby preventing rotation of the securing member 30.

F. Attachment Member

A door mount system includes an attachment member 40. As best seen in FIGS. 1-17, the attachment member 40 is connected to the front side portion 27 of the support member 20. The attachment member 40 is adapted to connect to an exercise device. The attachment member 40 may connect to the front side portion 27 of the support member 20 at any location. In an example embodiment, the attachment member 40 attaches to the front side portion 27 of the support member 20 at an end of the support member 20 opposite the top side portion 29. In an example embodiment, the attachment member 40 attaches to an outer surface of the front side portion 27 of the support member 20. The attachment member 40 may connect to the front side portion 27 in any manner. In an example embodiment, the attachment member 40 is welded to the support member 20. In an example embodiment, the attachment member 40 is integral with the front side portion 27.

The attachment member 40 is positioned at an angle 48 with respect to the front side portion 27 of the support member 20. Because the support member 20 is removably coupled to the door 10, the attachment member 40 is also positioned at an angle with respect to the door 10. In an example embodiment in which the front side portion 27 of the support member is parallel to a side of the door 10, attachment member 40 is positioned at the angle 48 with respect to the door 10. The angle 48 positions the attachment member 40 for attachment to an exercise device. The angle 48 may position the attachment member 40 to receive (e.g., resist, oppose) the force exerted by a user on the attachment member 40 via the exercise device. For example, the angle 48 may position the attachment member 40 orthogonally to the force exerted by the user.

The attachment member 40 may include any structure to facilitate attachment of the exercise device to the attachment member 40. For example, attachment member 40 may include one or more eyelets. In an example embodiment, the attachment member 40 includes a first eyelet 42, which is adapted to connect to an exercise device. In another example embodiment, as best shown in FIGS. 3-4 and 8-13, the attachment member 40 includes a first eyelet 42 and a second eyelet 44 adapted to connect to the exercise device. In an example embodiment that includes the eyelets 42 and 44, first eyelet 42 may be positioned with respect to second eyelet 44 to make a center of the first eyelet 42 and a center of the second eyelet 44 coaxial. The eyelets 42 and 44 may be positioned coaxially to each other along an axis 46. Positioning the first eyelet 42 coaxially to the second eyelet 44 facilitates positioning a threaded fastener, or some other connection member, through the eyelets 42 and 44.

In an example embodiment, the attachment member 40 includes the first eyelet 42 and the second eyelet 44. The attachment member 40 is connected to the front side portion 27 of the support member 20. The first eyelet 42 and the second eyelet 44 are adapted to connect to an exercise device. The first eyelet 42 is positioned coaxially to the second eyelet 44 along the axis 46. The axis 46 is positioned at an angle 48 with respect to the front side portion 27 of the support member 20 and thereby at an angle with respect to the door 10. In an example embodiment, axis 46 is positioned at the angle 48 with respect to the door.

Because the angle 48 positions the attachment member 40 at an angle with respect to the door 10, the attachment member 40 positions the first eyelet 42 and the second eyelet 44 at an angle with respect to the door 10. The attachment member 40 positions the first eyelet 42 and the second eyelet 44 at an angle with respect to the door 10 to evenly distribute a force from the exercise device between the first eyelet 42 and the second eyelet 44. The angle 48 may vary in different example embodiments, and should not be construed as limited by the example embodiment shown in the figures. For example, the angle 48 may be greater or lesser than the exemplary angle 48 shown in the figures.

Figure 11:
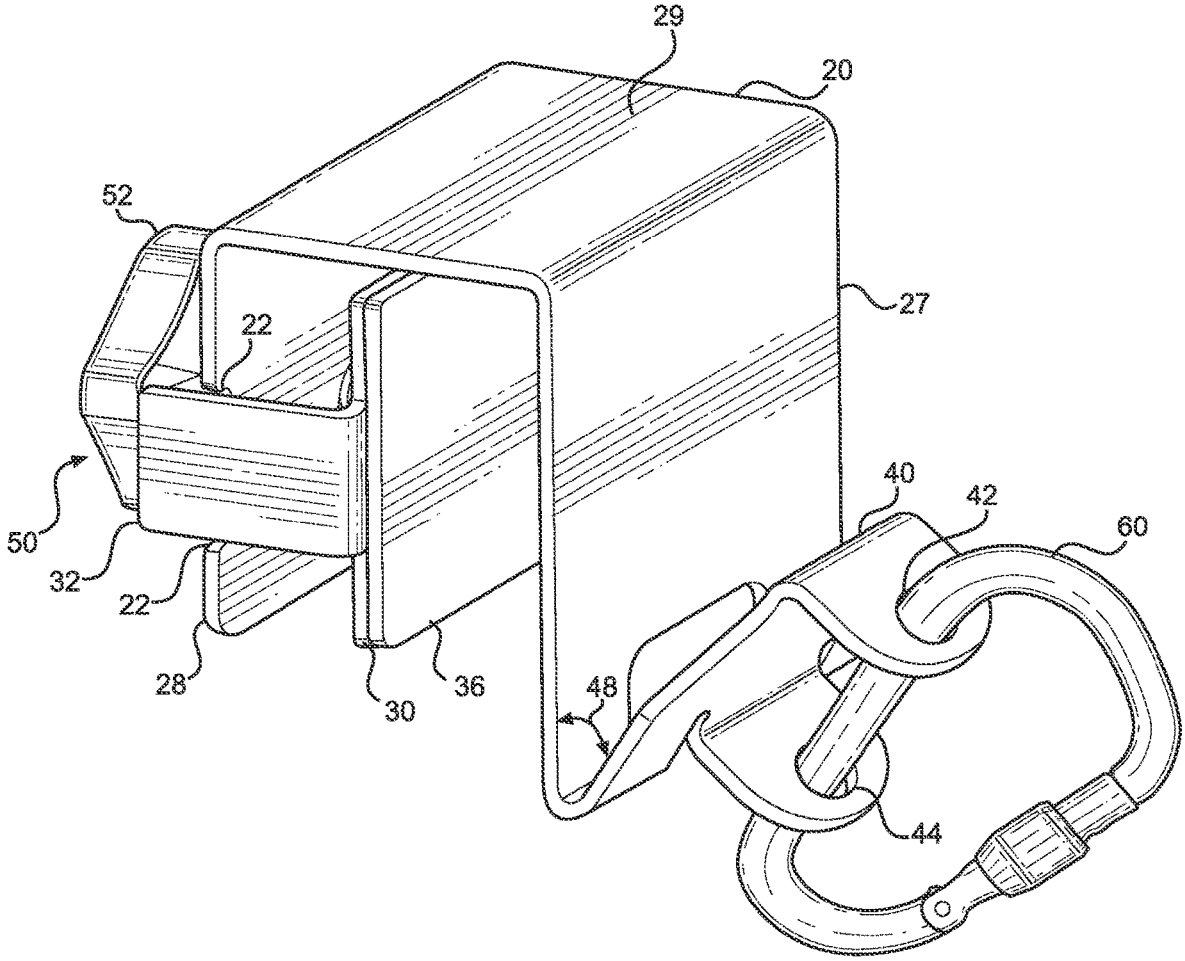
FIG. 11 is a left-side perspective view of the example embodiment with a carabiner hook attached.
Figure 12:
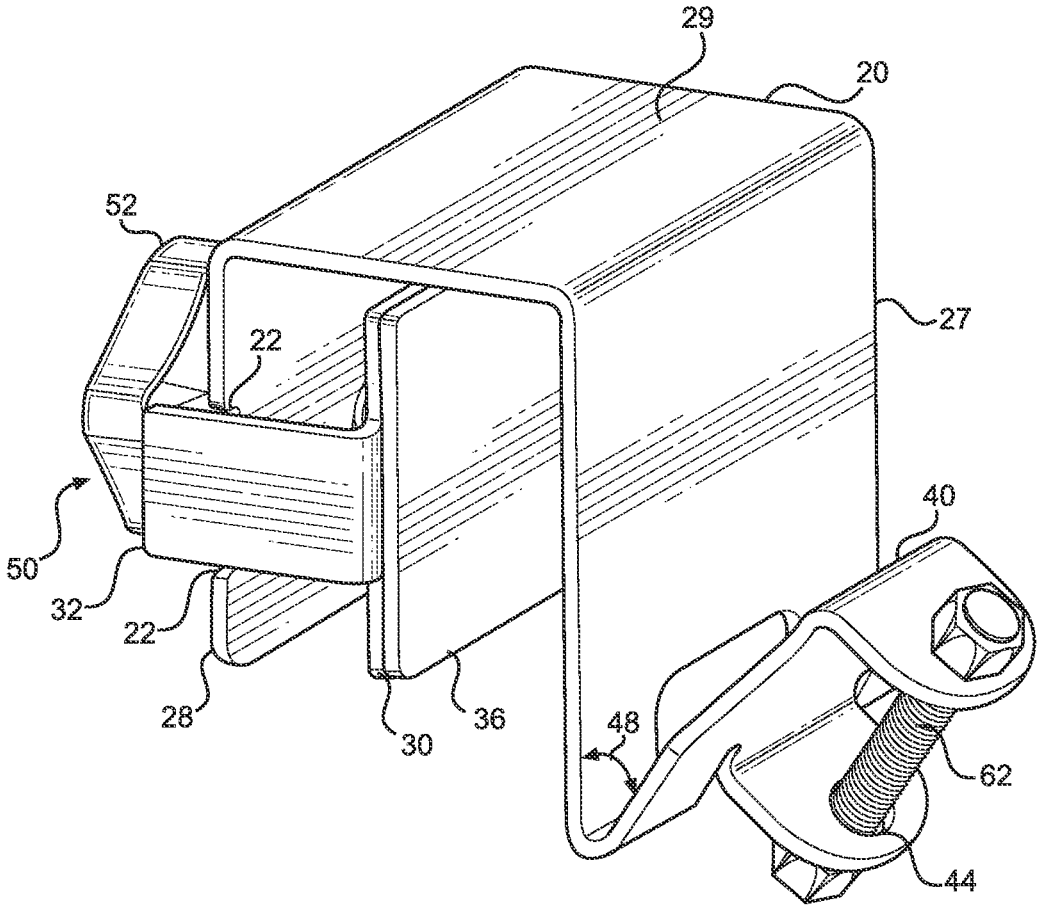
FIG. 12 is a left-side perspective view of the example embodiment with a threaded fastener attached.
Figure 13:
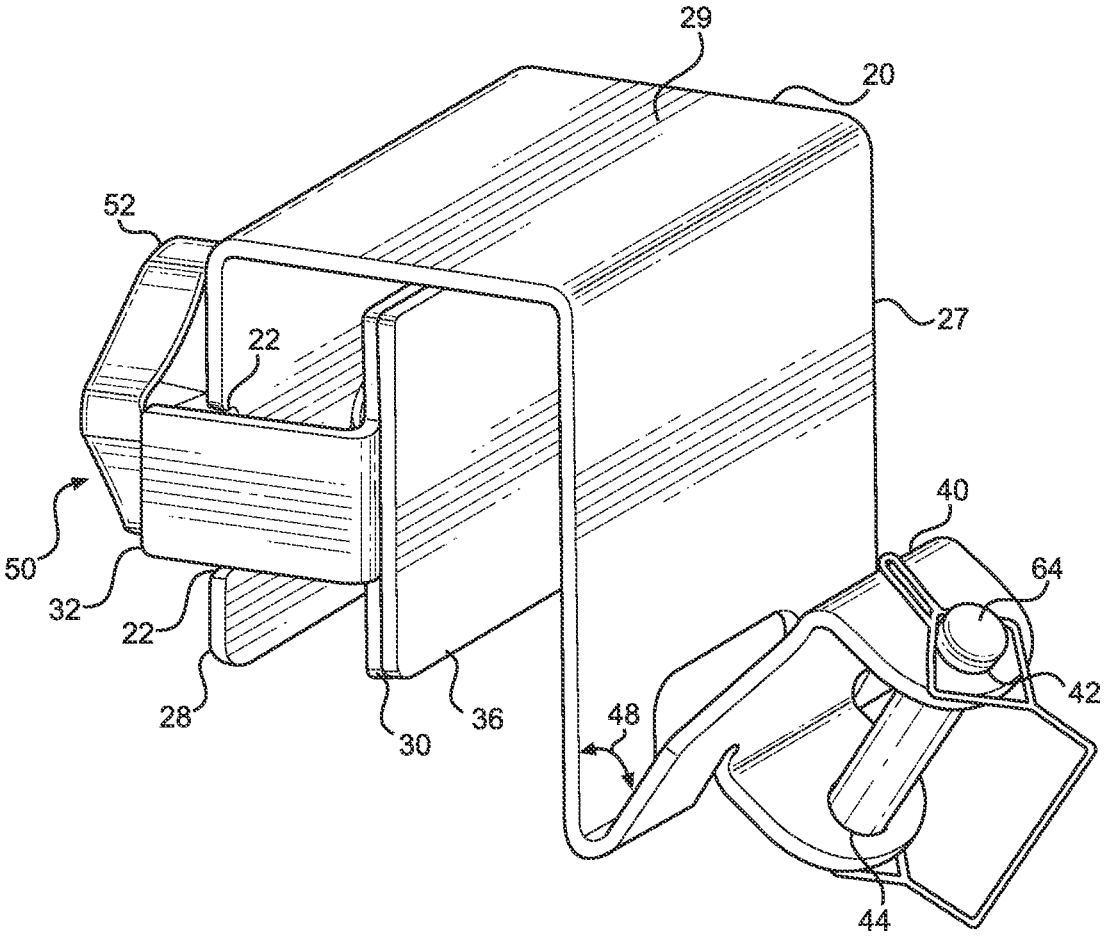
FIG. 13 is a left-side perspective view of the example embodiment with a wire-lock clevis pin attached.
Figure 14:
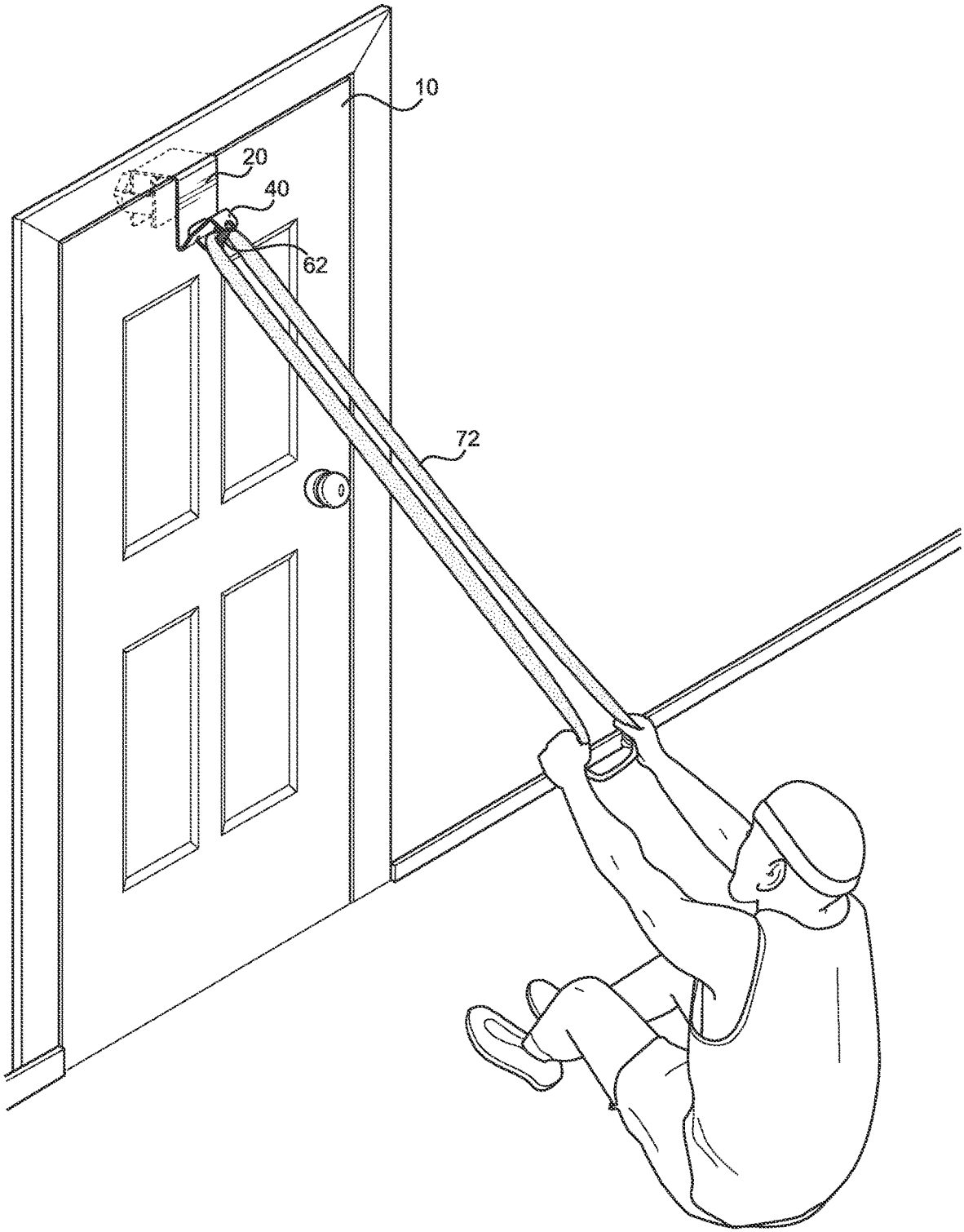
FIG. 14 is a left-side perspective view of the example embodiment connected to a resistance loop with an exerciser pulling upon the resistance loop.
Figure 15:
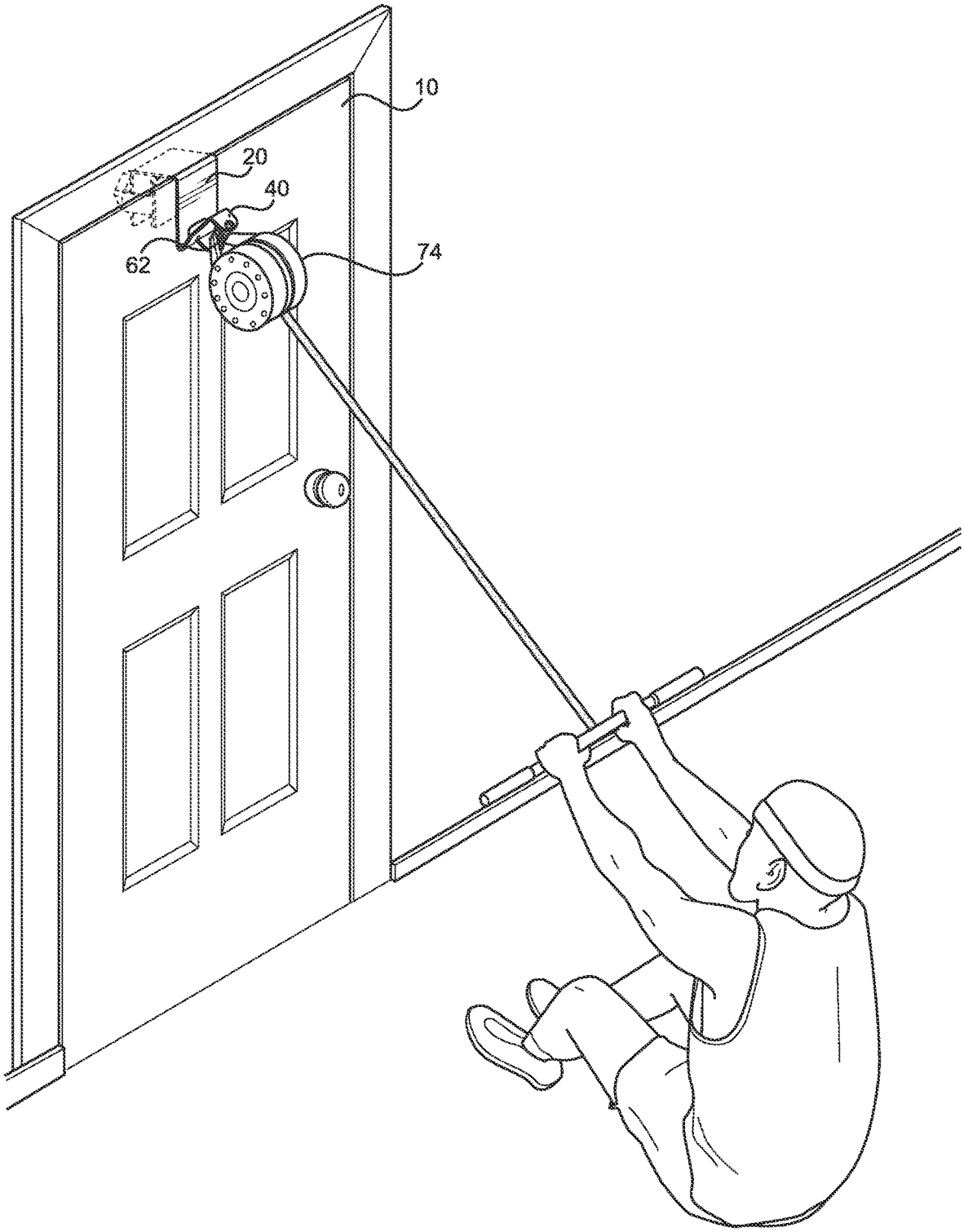
FIG. 15 is a left-side perspective view of the example embodiment connected to a resistance exercise machine.
Figure 16:
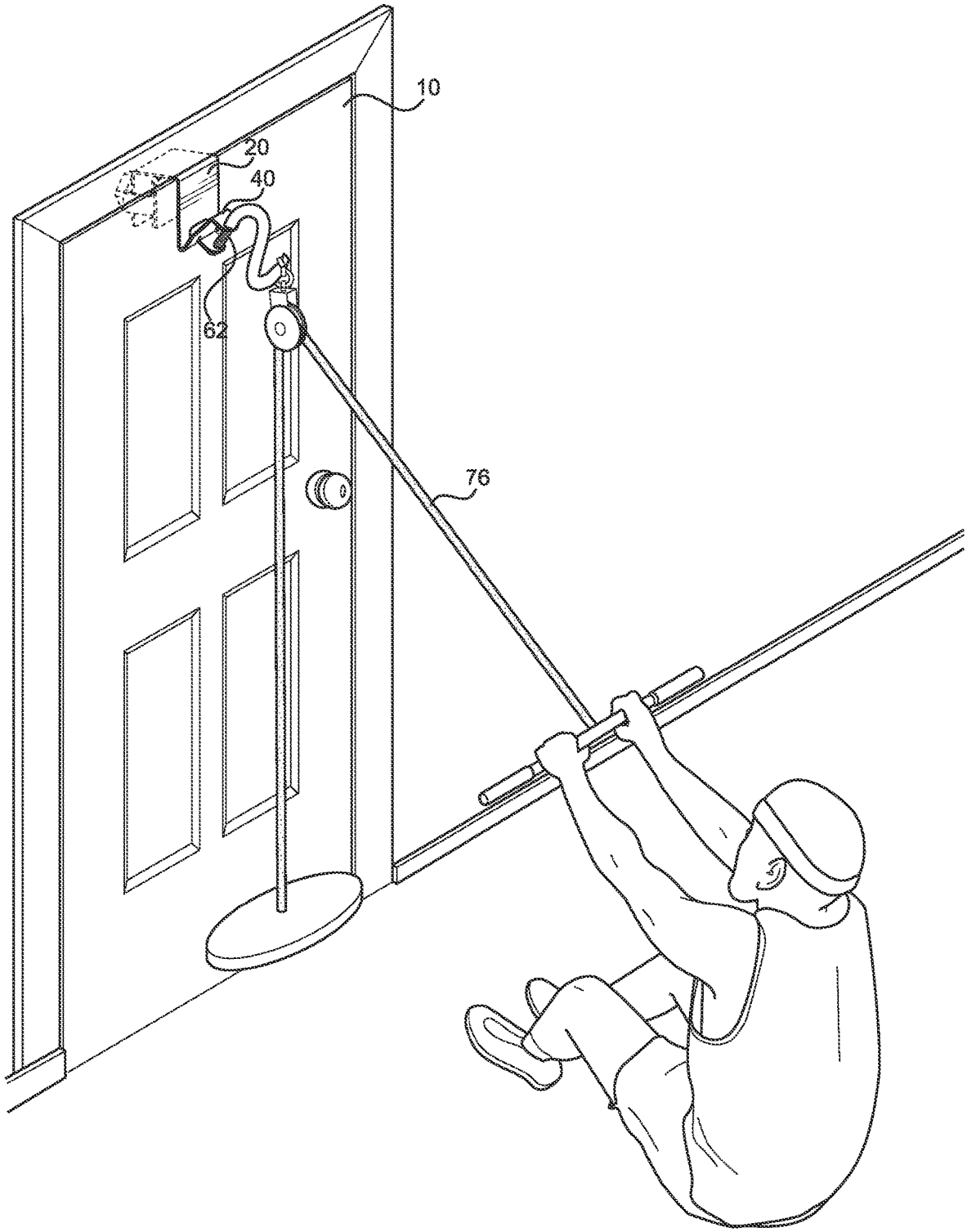
FIG. 16 is a left-side perspective view of the example embodiment connected to a weight and pulley exercise system.
Figure 17:
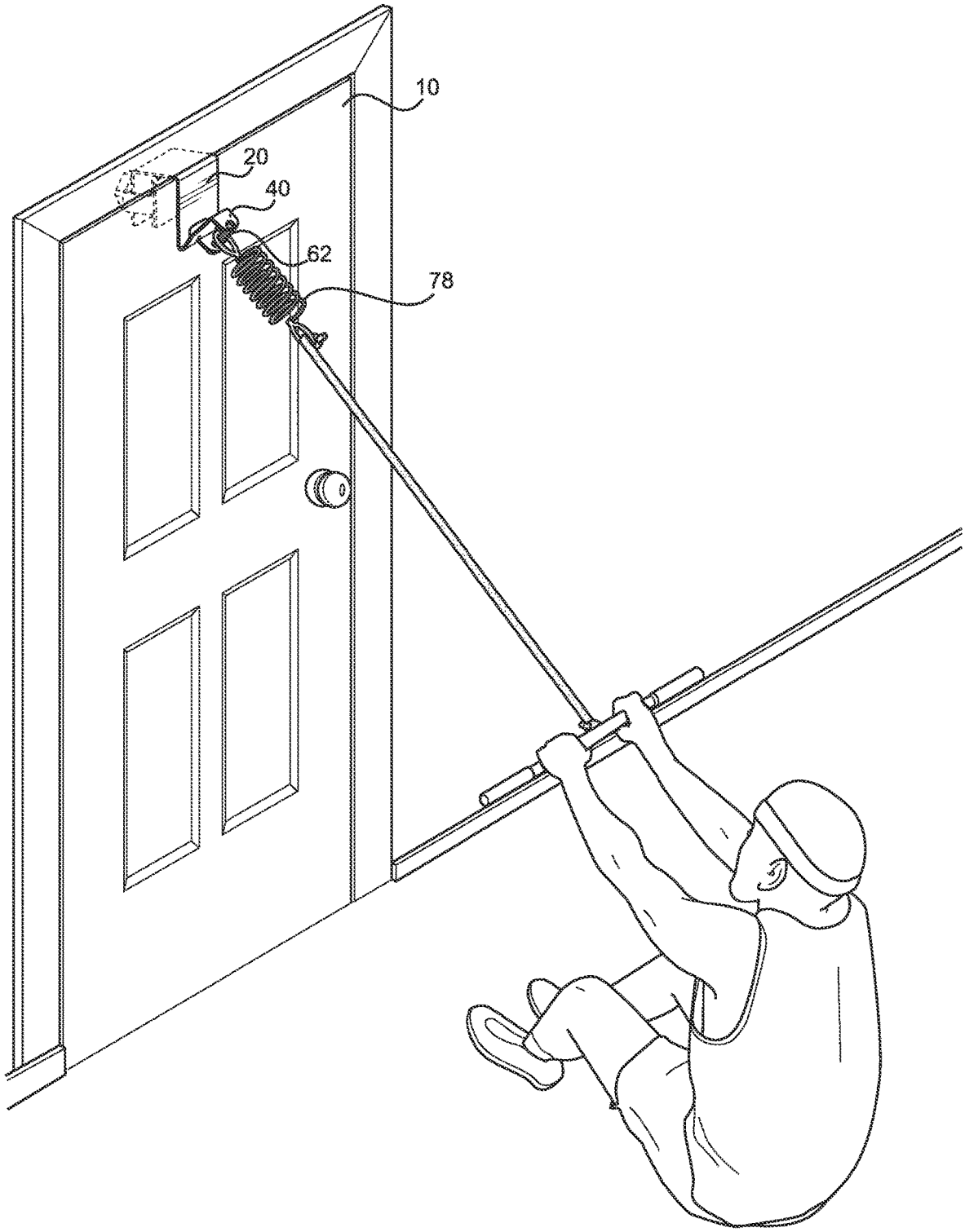
FIG. 17 is a left-side perspective view of the example embodiment connected to a resistance spring device being pulled upon by an exerciser.

A door mount system may further include a connection member. The connection member facilitates attaching the exercise device to the attachment member 40. The connection member includes any device that facilitates connecting the exercise device to the attachment member 40. As best seen in FIGS. 11-13, for example embodiments of the attachment member 40 that include the first eyelet 42 and the second eyelet 44, the connection member includes, among other things, a threaded fastener, a pin, a wire-lock clevis pin, a bolt, a hitch pin, a screw pin shackle, a cotter pin and a clip. A door mount system may include one or more of the above connection members, for example, a door mount system may further include the threaded fastener 62, the wire-lock clevis pin 64 or the carabiner 60. In an example embodiment, the threaded fastener 62, the wire-lock clevis pin 64 or the carabiner 60 may be positioned through the first eyelet 42 and the second eyelet 44 to facilitate connecting the exercise device to the first eyelet 42 and the second eyelet 44. The attachment member 40 positions the first eyelet 42 and the second eyelet 44 at an angle with respect to the door 10 to orient the threaded fastener 62, the wire-lock clevis pin 64 or the carabiner 60 to evenly distribute a force exerted by an exercise device between the first eyelet 42 and the second eyelet 44.

G. Example Embodiments

A door mount system includes various example embodiments. In a first example embodiment, the door mount system includes a support member 20, a securing member 30, a first guide member 32, a second guide member 34, the adjustment member 50 and an attachment member 40.

The support member 20 has a front side portion 27, a rear side portion 28, a top side portion 29 extending between the front side portion 27 and the rear side portion 28, a first slot 22 extending into a first side edge of the rear side portion 28, and a second slot 24 extending into a second side edge of the rear side portion 28. The first side edge is opposite of the second side edge. The support member 20 is adapted to removably connect to an upper end of a door 10.

The securing member 30 is adapted to move with respect to the support member 20 to press against the door 10 to removably connect the support member 20 to the door 10.

The first guide member 32 and the second guide member 34 extend from the securing member 30. The first guide member 32 and the second guide member 34 are slidably positioned in the first slot 22 and the second slot 24 respectively. As the securing member 30 moves, the first guide member 32 and a second guide member 34 are adapted to remain positioned in the first slot 22 and the second slot 24 respectively thereby preventing rotation of the securing member 30.

The adjustment member 50 is connected to the securing member 30 and the rear side portion 28 of the support member 20. The adjustment member 50 is adapted to move the securing member 30 towards or away from the door 10.

The attachment member 40 connected to the front side portion 27 of the support member 20. The attachment member 40 is adapted to connect to an exercise device.

A first example embodiment includes the first guide member 32, the second guide member 34, the first slot 22 and the second slot 24. In the first example embodiment, the attachment member 40 does not include the first eyelet 42 or the second eyelet 44.

In a second example embodiment, the door mount system includes a support member 20, a securing member 30, the adjustment member 50 and an attachment member 40. The support member 20 in the second example embodiment is the same as in the first example embodiment, except it omits the first slot 22 and the second slot 24. The securing member 30 and the adjustment member 50 in the second example embodiment are the same as in the first example embodiment. The attachment member 40 in the second example embodiment is the same as in the first example embodiment except it includes the first eyelet 42, which is adapted to connect to an exercise device. So, the second example embodiment omits the first guide member 32, the second guide member 34, the first slot 22 and the second slot 24, but includes the first eyelet 42.

A third example embodiment of the door mount system is the same as the second example embodiment except the attachment member 40 further includes second eyelet 44. So, the third example embodiment omits the first guide member 32, the second guide member 34, the first slot 22 and the second slot 24 but includes the first eyelet 42 and the second eyelet 44.

In a fourth example embodiment, the door mount system includes a support member 20, a securing member 30, the adjustment member 50, a first guide member 32, a second guide member 34 and an attachment member 40 that has the first eyelet 42 and the second eyelet 44. The support member 20 also includes the first slot 22 and the second slot 24 in the rear side portion 28 to slidably receive the first guide member 32 in the second guide member 34. Additional example embodiments are discussed above and in the claims.

H. Operation of Preferred Embodiment

In use, a door mount system is attached to a door 10 to hold an exercise device for use by a user. A door mount system may be attached to the door 10 prior to use. A user may prepare the door mount system for attaching to the door 10 by turning knob 52 counterclockwise to move securing member 30 toward the rear side portion 28 of the support member 20. Turning knob 52 counterclockwise causes the adjustment member 50 to move the securing member 30 toward the rear side portion 28. When the distance between the securing member 30 and the inner surface of the front side portion 27 is more than the width of the door 10, the user opens the door 10 and places the support member 20 over the top of the door 10 like an inverted-U. Placing the support member 20 on the top of the door 10 brings the inner surface of the top side portion 29 into contact with the door 10.

While the support member 20 is positioned on top of the door 10, the user rotates knob 52 in a clockwise direction. Rotating the knob 52 in the clockwise direction rotates the threads of bolt 54 in the clockwise direction against the threads in the nut 56, which moves the securing member 30 away from the rear side portion 28 of the support member 20 and toward the door 10.

As the securing member 30 moves away from the rear side portion 28 of the support member 20, the guide members 32 and 34 are positioned in and slidably move in the slots 22 and 24 respectively. As the securing member 30 moves away from the rear side portion 28 of the support member 20, the guide members 32 and 34 remain positioned in the slots 22 and 24 respectively.

The user turns knob 52 until securing member 30 and second gripping member 36 come into contact with the door 10. The user continues to turn knob 52 until the securing member 30 pushes the door 10 into contact with the front side portion 27 of the support member 20 and first gripping member 26. Even after the securing member 30 pushes the door 10 into contact with the front side portion 27, the user continues to rotate knob 52 in the clockwise direction until securing member 30 applies sufficient force on the door 10 to hold the door 10 between the securing member 30 and the front side portion 27 of the support member 20. Pressing the door 10 between the securing member 30 and the front side portion 27 also presses the door 10 between the second gripping member 36 and first gripping member 26. Pressing the door 10 between the securing member 30 and the front side portion 27 removably couples the support member 20 to the door 10.

As the user rotates knob 52 and as the securing member 30 moves, the guide members 32 and 34 remain positioned in the slots 22 and 24. As the securing member 30 moves, contact between edges of the slots 22 and 24 with the guide members 32 and 34 prevent the securing member 30 from rotating.

Figure 2:
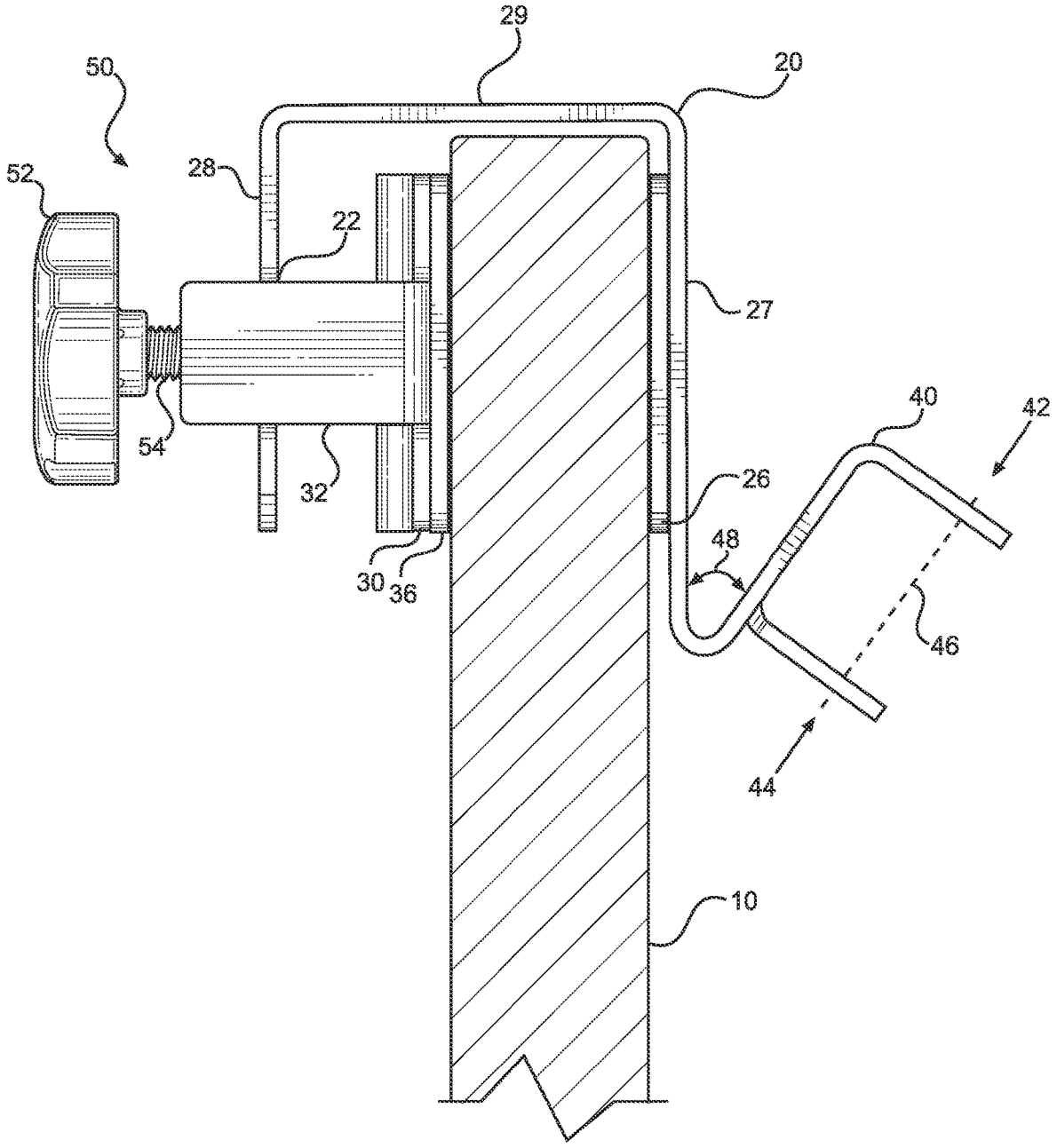
FIG. 2 is a left-side view of the example embodiment attached to a door.
Figure 3:
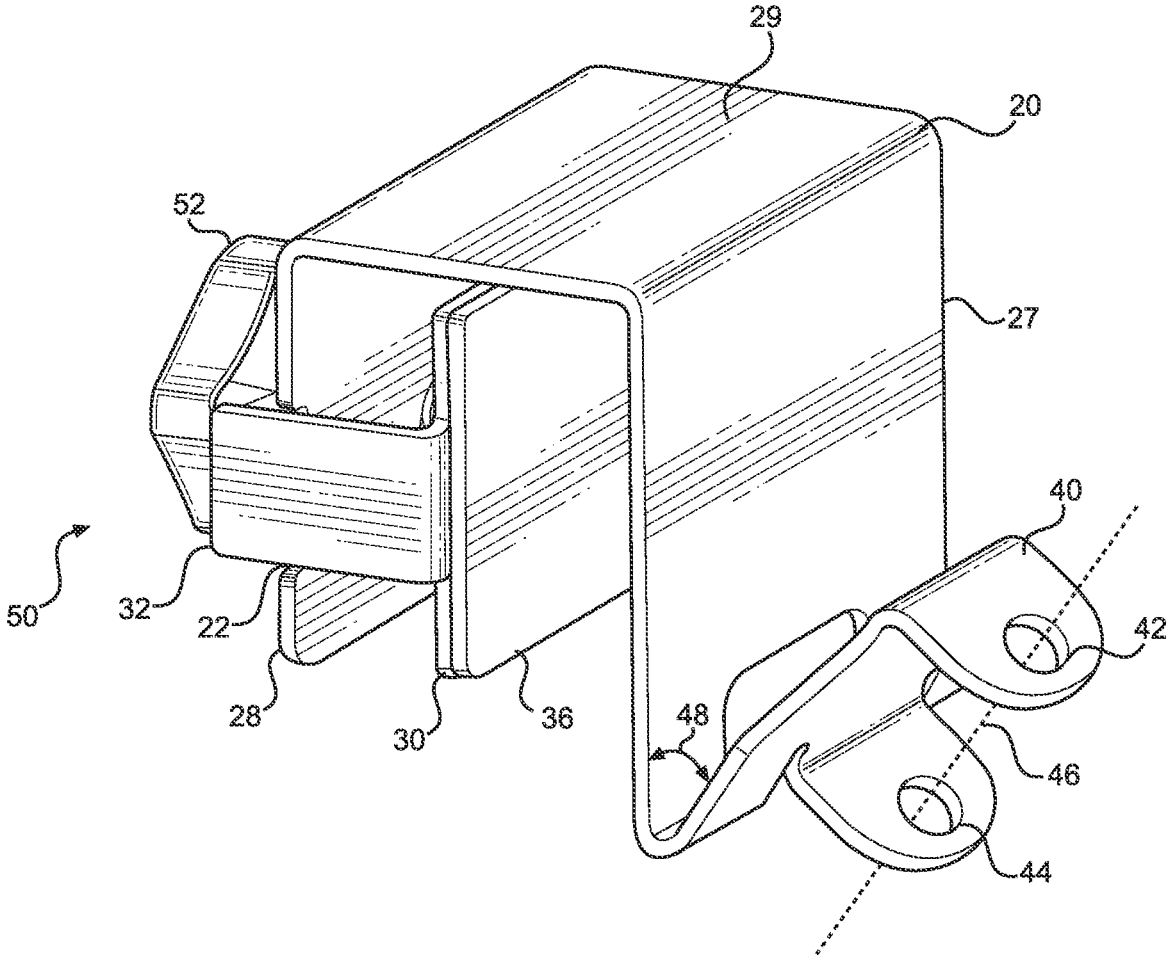
FIG. 3 is a left-side perspective view of the example embodiment.
Figure 4:
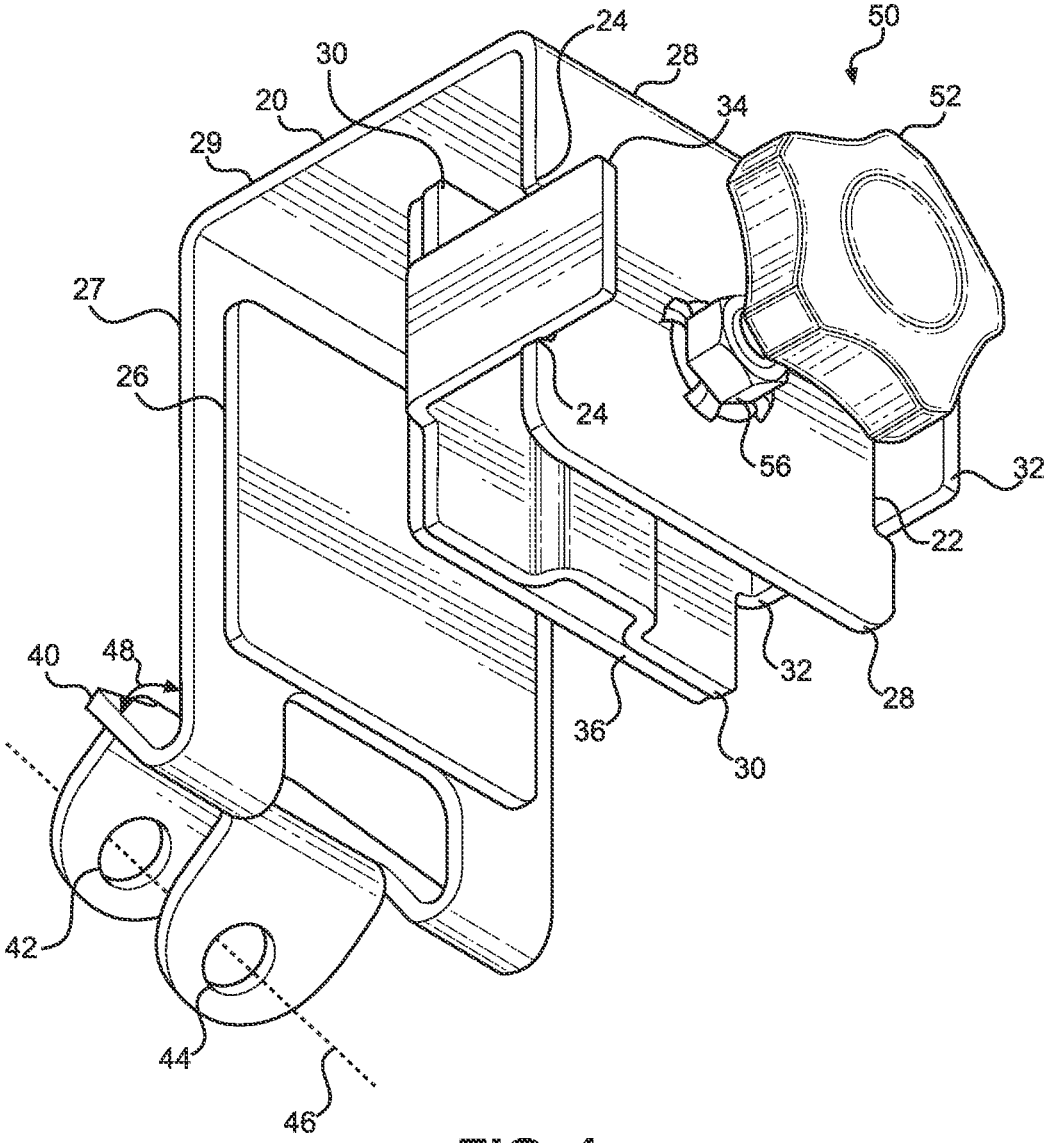
FIG. 4 is a bottom side perspective view of the example embodiment.
Figure 5:
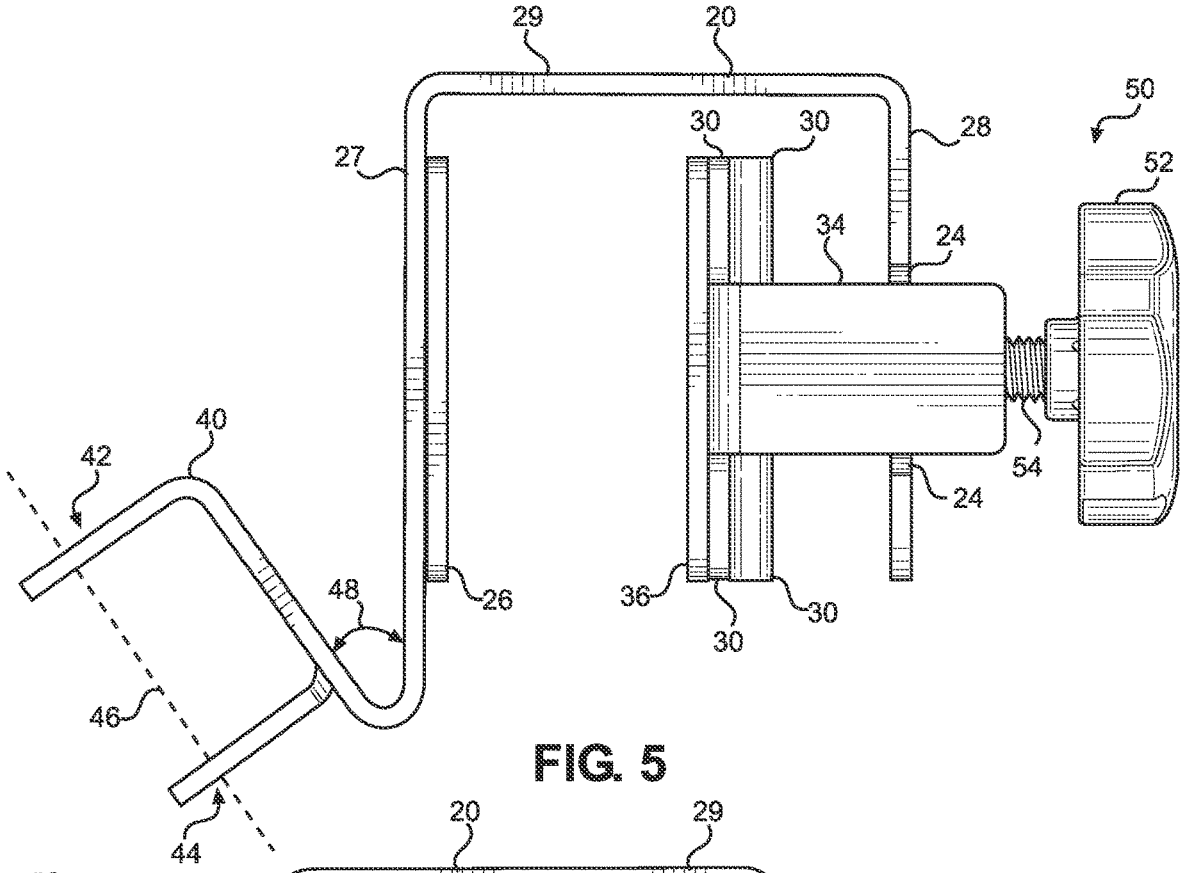
FIG. 5 is a right-side view of the example embodiment.
Figure 6:
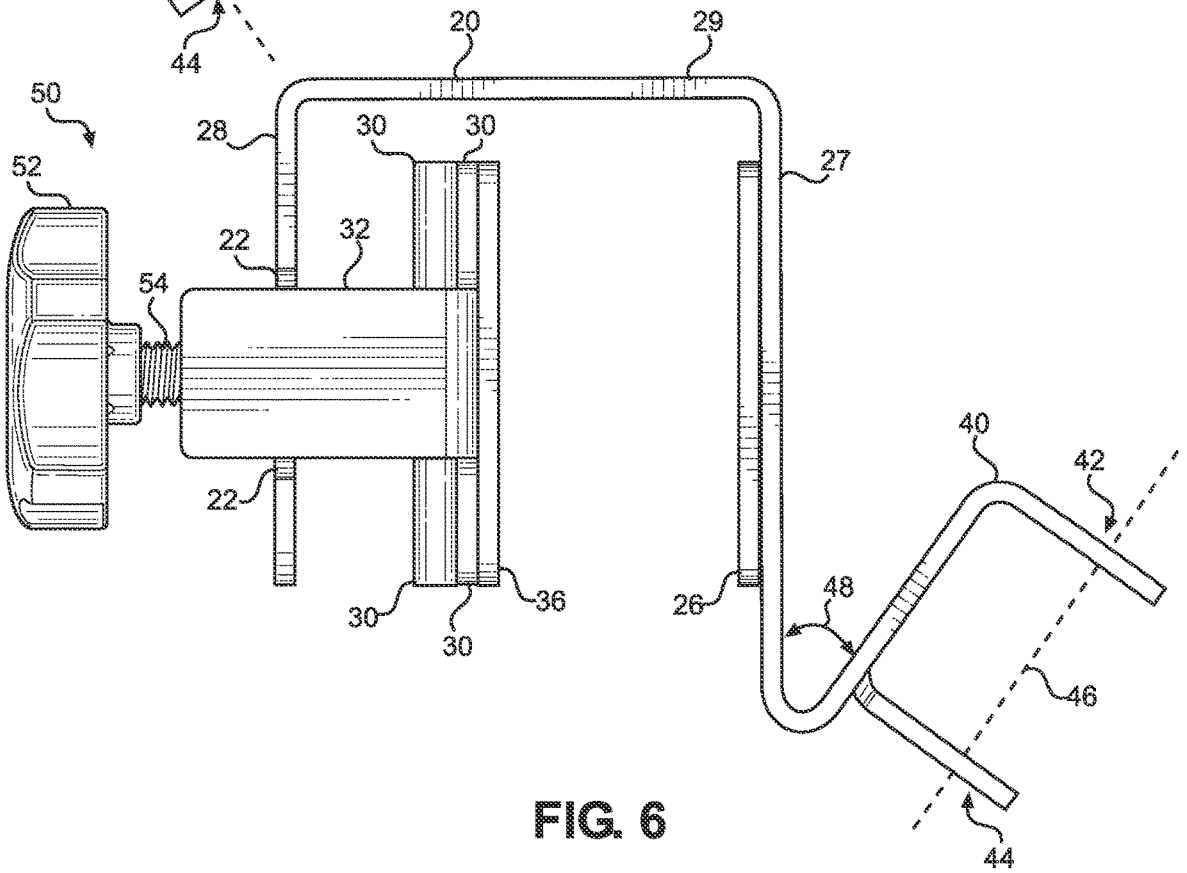
FIG. 6 is a left-side view of the example embodiment.
Figure 7:
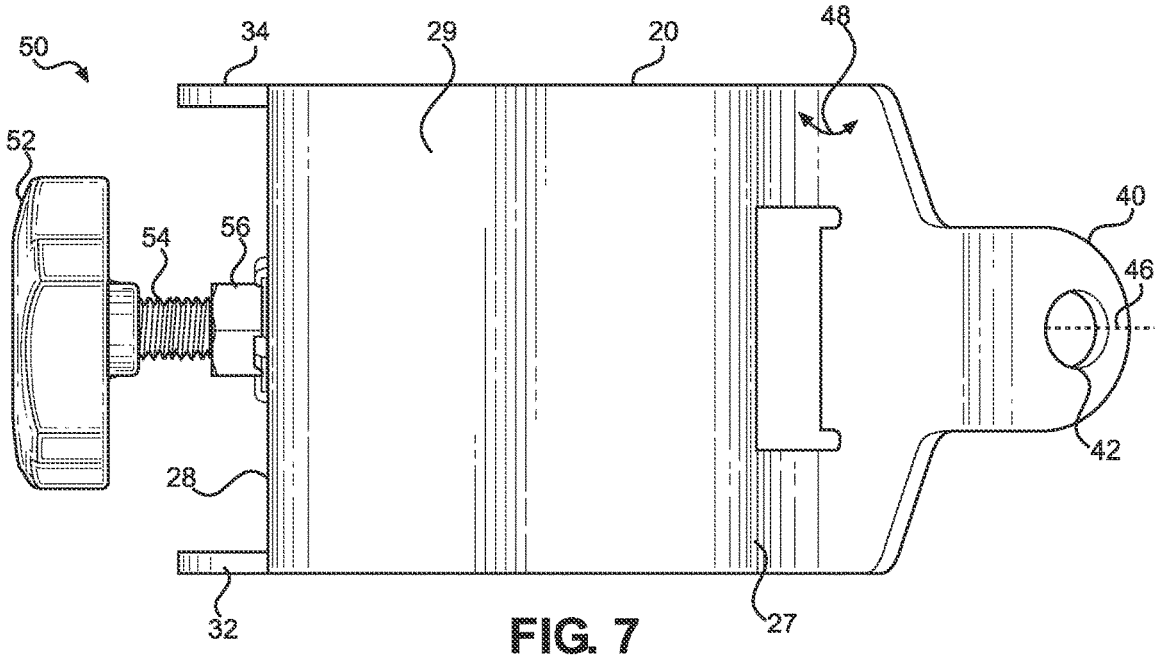
FIG. 7 is a top view of the example embodiment.
Figure 8:
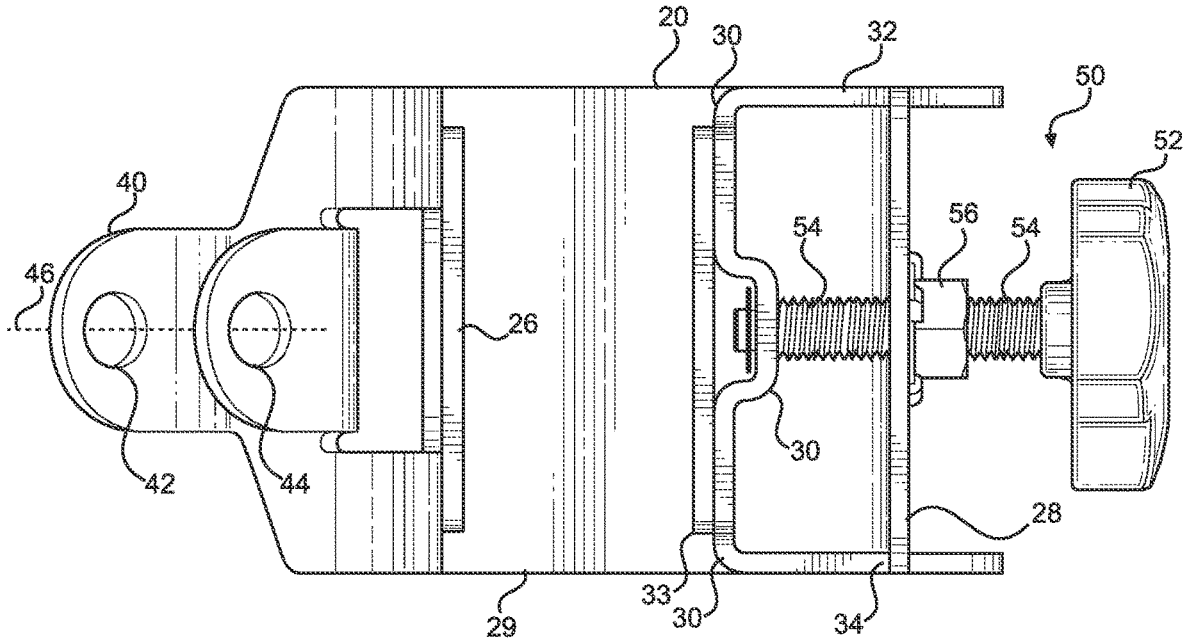
FIG. 8 is a bottom view of the example embodiment.
Figure 9:
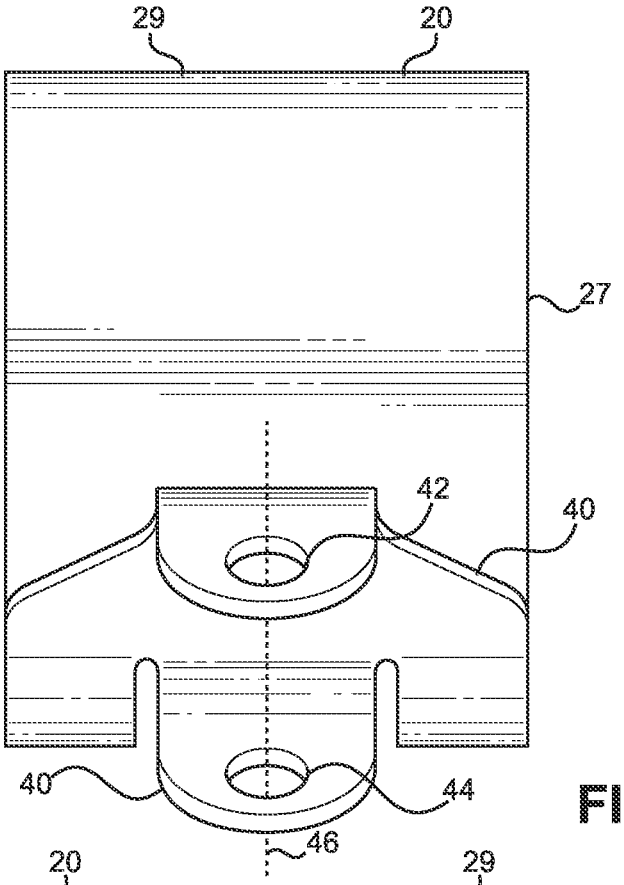
FIG. 9 is a front view of the example embodiment.
Figure 10:
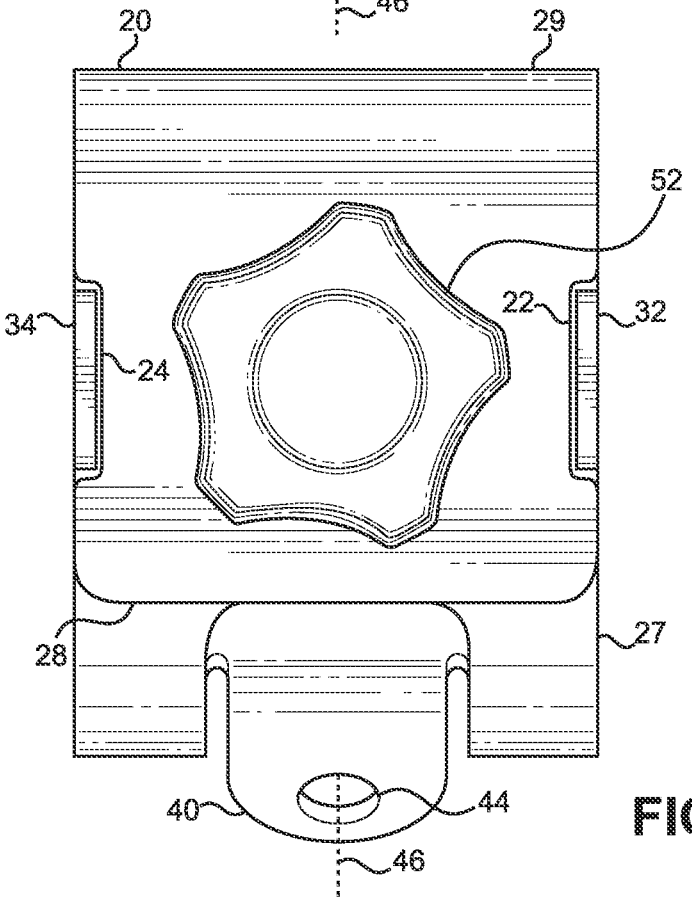
FIG. 10 is a rear view of the example embodiment.

The user rotates the knob 52 until the securing member 30 firmly presses against the door 10 and the support member 20 is firmly attached (e.g., secured) to the door 10. As best shown in FIG. 2, the securing member 30 continues to press against the door 10 to keep the support member 20 attached to the door 10

With the support member 20 in position, the user may attach an exercise device to the attachment member 40. The user may close the door 10 so that the door 10 will not move as the user exercises. As discussed above, a variety of connection members may be positioned through the first eyelet 42 and the second eyelet 44 of attachment member 40 to facilitate coupling an exercise device to the attachment member 40. As best shown in FIGS. 11-13, the user may position (e.g., insert) a carabiner 60, threaded fastener 62, or wire-lock clevis pin 64 through the eyelets 42 and 44 to facilitate connecting the exercise device to the eyelets 42 and 44 and to the attachment member 40.

One or more of types of exercise devices may be attached to the attachment member 40 or to one or more eyelets 42, 44 with or without the connection member. As shown in FIGS. 1 and 14-17, example exercise devices that may be attached to the attachment member 40 may include one or more elastic members 70 (e.g. resistance bands made of rubber or elastic cord; coil spring, etc.), resistance loops 72 (e.g. rubber loops, polyester-cotton workout bands, etc.), a resistance device 74 (e.g., linear, nonlinear), a pulley device 76, and a spring device 78 (e.g. a coil spring connected to a flexible elongated member). An example of a suitable exercise device that may be connected to the attachment member 40 is U.S. Pat. No. 10,780,307 to Sebastien Lagree titled "Adjustable Resistance Exercise Machine". U.S. Pat. No. 10,780,307, the entire disclosure of which, except for any definitions, disclaimers, disavowals, and inconsistencies, is incorporated herein by reference. The above listing of example exercise devices connectable to the various example embodiments disclosed herein is not limiting as many other types of exercise devices may be connected.

After use or after a period of time, a user may decide to remove the door mount system from the door 10. To remove the door mount system from the door 10, the user rotates knob 52 in the counterclockwise direction. Rotating knob 52 in the counterclockwise direction rotates the threads of bolt 54 against the threads in nut 56 to move the securing member 30 away from the door 10 and toward the rear side portion 28 of the support member 20. Moving the securing member 30 away from the door 10 releases the pressure applied by the securing member 30 on the door 10. Releasing the pressure applied on the door 10 reduces the pressure applied by the door 10 against the front side portion 27 of the support member 20. As the securing member 30 moves out of contact with the door 10, the pressure applied to the door 10 and to the front side portion 27 of the support member 20 goes to zero. The user continues to rotate knob 52 in the counterclockwise direction until the distance between the securing member 30 and the front side portion 27 of is greater than the width of the door 10. Once the door mount system is decoupled from the door 10, the door mount system may be removed from the top of the door 10. The door 10 must be open to remove the door mount system from the door 10.

As the securing member 30 moves away from the door 10 and toward the rear side portion 28 of the support member 20, the guide members 32 and 34 are positioned in and slidably move in the slots 22 and 24 respectively. As the securing member 30 moves away from the door 10 and toward the rear side portion 28 of, the guide members 32 and 34 remain positioned in the slots 22 and 24 respectively.

Unless otherwise defined, all technical and scientific terms used herein have the same meaning as commonly understood by one of ordinary skill in the art to which this invention belongs. Although methods and materials similar to or equivalent to those described herein can be used in the practice or testing of the various embodiments of the present disclosure, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The various embodiments of the present disclosure may be embodied in other specific forms without departing from the spirit or essential attributes thereof, and it is therefore desired that the various embodiments in the present disclosure be considered in all respects as illustrative and not restrictive. Any headings utilized within the description are for convenience only and have no legal or limiting effect.

What is claimed is:

1. A door mount system, comprising:

a support member having a front side portion, a rear side portion, a top side portion extending between the front side portion and the rear side portion, a first slot extending into a first side edge of the rear side portion, and a second slot extending into a second side edge of the rear side portion, wherein the first side edge is opposite of the second side edge, wherein the support member has an inverted U-shape, wherein the support member is adapted to removably connect to an upper end of a door;

a securing member adapted to move with respect to the support member, wherein the securing member is adapted to press against the door so as to removably connect the support member to the door;

a first guide member and a second guide member extending from the securing member, wherein the first guide member and the second guide member are slidably positioned in the first slot and the second slot respectively, wherein as the securing member moves, the first guide member and the second guide member are adapted to remain positioned in the first slot and the second slot respectively thereby preventing rotation of the securing member;

an adjustment member connected to the securing member and the rear side portion of the support member, wherein the adjustment member is adapted to move the securing member towards or away from the door; and an attachment member connected to the front side portion of the support member, wherein the attachment member is adapted to connect to an exercise device.

2. The door mount system of claim 1, wherein the attachment member comprises an eyelet adapted to connect to the exercise device.

3. The door mount system of claim 1, wherein the attachment member comprises a first eyelet and a second eyelet adapted to connect to the exercise device.

4. The door mount system of claim 3, wherein a first center of the first eyelet and a second center of the second eyelet are coaxial.

5. The door mount system of claim 3, wherein the first eyelet and the second eyelet are each positioned at an angle with respect to the door so as to evenly distribute a force from the exercise device between the first eyelet and the second eyelet.

6. The door mount system of claim 3, further comprising a connection member positioned through the first eyelet and the second eyelet to facilitate connecting the exercise device to the first eyelet and the second eyelet.

7. The door mount system of claim 6, wherein the first eyelet and the second eyelet are each positioned at an angle with respect to the door to orient the connection member to evenly distribute a force exerted by an exercise device between the first eyelet and the second eyelet.

8. The door mount system of claim 1, wherein the first guide member and the second guide member each extend orthogonally from the securing member.

9. The door mount system of claim 1, wherein the securing member comprises a plate.

10. The door mount system of claim 1, wherein the first guide member and the second guide member each comprises a first tab and a second tab respectively.

11. The door mount system of claim 1, wherein the adjustment member comprises a threaded member connected to the securing member and the rear side portion of the support member, wherein the securing member is adapted to move responsive to rotation of the threaded member.

12. The door mount system of claim 11, wherein the threaded member is threadably connected to the rear side portion of the support member.

13. The door mount system of claim 1, wherein the support member further comprises a first gripping member connected to an inner surface of the front side portion, wherein the securing member is adapted to press the door against the first gripping member to removably connect the support member to the door.

14. The door mount system of claim 13, wherein the securing member further comprises a second gripping member connected to a surface of the securing member, wherein the securing member is adapted to press the door between the first gripping member and the second gripping member to removably connect the support member to the door.

15. A door mount system, comprising:

a support member having a front side portion, a rear side portion and a top side portion extending between the front side portion and the rear side portion, wherein the support member has an inverted U-shape, wherein the support member is adapted to removably connect to an upper end of a door;

a securing member is adapted to move with respect to the support member to press against the door to removably connect the support member to the door;

an adjustment member connected to the securing member and the rear side portion of the support member, wherein the adjustment member is adapted to move the securing member towards or away from the door;

an attachment member having a first eyelet and a second eyelet, wherein the attachment member is connected to the front side portion of the support member, wherein the first eyelet and the second eyelet are adapted to connect to an exercise device; and a threaded fastener, a wire-lock clevis pin or a carabiner positioned through the first eyelet and the second eyelet to facilitate connecting the exercise device to the first eyelet and the second eyelet.

16. The door mount system of claim 15, wherein the support member further comprises a first gripping member connected to an inner surface of the front side portion, wherein the securing member is adapted to press the door against the first gripping member to removably connect the support member to the door.

17. The door mount system of claim 16, wherein the securing member further comprises a second gripping member connected to a surface of the securing member, wherein the securing member is adapted to press the door between the first gripping member and the second gripping member to removably connect the support member to the door.

18. The door mount system of claim 15, wherein the adjustment member comprises a threaded member connected to the securing member and the rear side portion of the support member, wherein the securing member is adapted to move responsive to rotation of the threaded member.

19. A door mount system comprising:

a support member having a front side portion, a rear side portion, a top side portion extending between the front side portion and the rear side portion, a first slot extending into a first side edge of the rear side portion, and a second slot extending into a second side edge of the rear side portion, wherein the first side edge is opposite of the second side edge, wherein the support member has an inverted U-shape, wherein the support member is adapted to removably connect to an upper end of a door;

a securing member adapted to move with respect to the support member to press against the door to removably connect the support member to the door;

a first guide member and a second guide member extending from the securing member, wherein the first guide member and the second guide member are slidably positioned in the first slot and the second slot respectively, wherein as the securing member moves, the first guide member and the second guide member are adapted to remain positioned in the first slot and the second slot respectively thereby preventing rotation of the securing member;

an adjustment member connected to the securing member and the rear side portion of the support member, wherein the adjustment member is adapted to move the securing member towards or away from the door; and an attachment member having a first eyelet and a second eyelet, wherein the attachment member is connected to the front side portion of the support member, wherein the first eyelet and the second eyelet are adapted to couple to an exercise device.

* * * * *